US005314115A

United States Patent [19]

Moucessian

[11] Patent Number: 5,314,115

[45] Date of Patent: May 24, 1994

[54] RAIL CROSS-TIE FOR LIM TRANSIT SYSTEM

[75] Inventor: Andranik Moucessian, Kingston, Canada

[73] Assignee: Bombardier Inc., Canada

[21] Appl. No.: 889,526

[22] Filed: May 27, 1992

[51] Int. Cl.[5] ..... E01B 3/00

[52] U.S. Cl. ..... 238/30; 238/62; 238/70; 238/106; 238/377; 238/310

[58] Field of Search ..... 104/290, 292; 238/2, 238/3, 4, 5, 29, 30, 45, 54, 56, 55, 62, 63, 79, 70, 78, 72, 73, 74, 75, 76, 77, 106, 382, 310, 377; 24/514, 569, 290; 403/405.1, 407.1, 243, 260, 258

[56] References Cited

U.S. PATENT DOCUMENTS

| | | | |
|---|---|---|---|
| 285,842 | 10/1883 | Putnam . | |
| 371,110 | 10/1887 | Troxell . | |
| 641,697 | 1/1900 | Hennebique . | |
| 664,042 | 12/1900 | Hillyer . | |
| 822,217 | 5/1906 | Minerd . | |
| 1,036,234 | 8/1912 | Henry | 238/30 |
| 1,101,436 | 6/1914 | Hettmansperger . | |
| 1,214,245 | 1/1917 | Waples | 238/30 |
| 1,243,084 | 10/1917 | McCready . | |
| 1,257,247 | 2/1918 | Klein | 238/63 |
| 1,375,773 | 4/1921 | Bryant | 238/30 |
| 2,153,624 | 4/1939 | Jones | 238/10 |
| 3,233,559 | 2/1966 | Smith et al. | 104/292 |
| 3,616,999 | 11/1971 | Ruble | 238/315 |
| 3,877,640 | 4/1975 | Hemmady | 238/2 |
| 4,728,032 | 3/1988 | Beigl et al. | 238/2 |

FOREIGN PATENT DOCUMENTS

| | | | |
|---|---|---|---|
| 0705655 | 5/1941 | Fed. Rep. of Germany . | |
| 0414324 | 8/1946 | Italy . | |
| 0018610 | 2/1977 | Japan | 238/2 |
| 0222603 | 9/1989 | Japan | 104/290 |
| 4-14501 | 1/1992 | Japan | 104/290 |

*Primary Examiner*—Mark T. Le
*Attorney, Agent, or Firm*—Ladas & Parry

[57] ABSTRACT

A rail tie has a pair of rail supporting portions disposed on opposite sides of a central portion. The central portion is elevated relative to the central portion and supports a reaction rail of a linear induction motor used to propel a vehicle along the guideway. The reaction rail is secured to flanges extending laterally from the central portion to reduce the unsupported span of the reaction rail between ties. The tie is supported on the deck of the guideway by resilient pads. An eccentric insert cooperates with a securing stud to allow alignment of the tie.

24 Claims, 5 Drawing Sheets

RAIL CROSS-TIE FOR LIM TRANSIT SYSTEM

Figure 1:
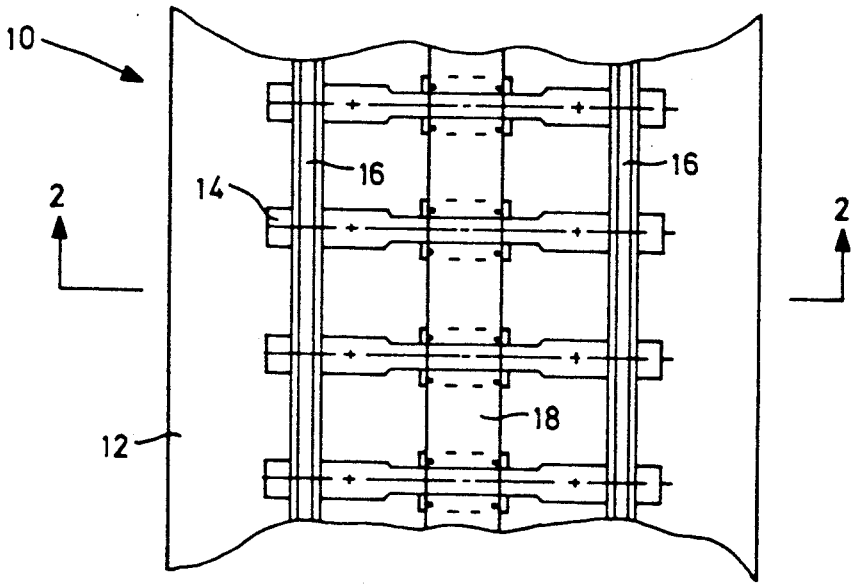

The present invention relates to ties for railways and to guideways using such ties.

Conventional railways utilize a track having a pair of rails held in position by a tie extending transversely between the rails. The ties are supported on a ballast bed which provides a degree of resilience for the rail as the vehicle passes along the guideway.

In transit systems such as urban people movers and streetcars, it is not always convenient to provide a ballasted track and it becomes necessary to support the track on a concrete deck. The axle loads of such transit vehicles which utilize steel wheels rolling on steel rails are generally less than conventional rail vehicles. The direct fixation of the rail to the deck can lead to unacceptable vibration in both the deck and the vehicle. This can be mitigated to a certain extent by providing a relatively soft primary suspension for the vehicle.

In certain applications soft primary suspensions cannot be used. One such application is where a linear induction motor is carried by the vehicle and used as the primary source of propulsion. This propulsion method avoids the transmission of torque through the wheels to the rails and so reduces wear and maintenance costs. The linear induction motor (LIM) consists of a primary supported on the vehicle and a reaction rail installed between the running rails to complete the flux path from the primary to propel or retard the vehicle. With such systems, the efficiency of the LIM is affected by variations in the air gap between the primary and the reaction rail. In order to minimize the variations and maintain the desired gap, it is necessary to utilize a stiff primary suspension and thereby inhibit relative movement between the wheels and the portion of the vehicle carrying the LIM primary. With previous guideways, the need to maintain the air gap within a tolerance of typically 1 mm required the track to be designed to achieve a high track stiffness. This ensures small dynamic track deflections as the vehicle passed along the guideway. With such prior arrangements, the rails were fastened directly to the deck through individual rail fasteners secured to the concrete deck and the LIM reaction rail was supported on studs secured in the concrete deck and projecting upwardly to the required height of the reaction rail. The studs allowed adjustment of the height of the reaction rail relative to the running rails to set the nominal clearance between the top of the rail and the reaction rail.

Such an arrangement has operated successfully in revenue service but as a result of that operating experience, certain undesirable characteristics have been identified. There is a tendency due to the high track stiffness for the rails to corrugate which leads to high and at times unacceptable noise and vibration levels in the vehicle and deck. The cost of the guideway is also high due in part to the additional material and installation requirements of the LIM reaction rail. A further problem identified with the existing installation was the loosening or failure of the LIM rail support studs due in part to the relatively long unsupported length of the studs necessary to support the LIM reaction rail at the required height.

Previous proposals to provide lower stiffness guideways for transit systems include the use of floating slabs, monoblock concrete ties supported on thick resilient pads, two-block concrete ties in rubber boots embedded in recessed pockets in the guideway surface, and the use of highly resilient Cologne Egg direct fixation fasteners.

While each of these proposals has some desirable feature, none of them satisfy the criteria for a LIM-powered transit system. Floating slabs are heavy, very expensive and not suitable for application on elevated guideways. Monoblock concrete ties are heavy and lead to higher dead loads on the guideway compared to the system in prior use. This is due both to its own weight and to the additional height of the parapets running along the side of the guideway which is required because of the higher elevation of the rail support area. Rubber-booted two-block ties also lead to high dead loads, as well as difficulties with the installation of the reaction rail. The Cologne Egg fasteners provide the degree of resilience required but are expensive and do not permit the air gap tolerance to be maintained between the reaction rail and the primary when in use.

It is therefore an object of the present invention to provide a guideway and tie that will obviate or mitigate the above disadvantages.

According to the present invention, there is provided a rail tie comprising an elongate body having a central portion and a pair of rail supporting portions located on opposite sides of said central portion, each of said rail supporting portions including an upwardly directed rail support pad to receive a rail, said central portion being elevated relative to said pads and providing a support for a reaction rail extending between adjacent ties.

According also to the present invention, there is provided a guideway for a rail vehicle comprising a deck, a plurality of ties spaced apart generally parallel to one another transverse to the direction of movement of the vehicle along said guideway, each of said ties having a central portion and a pair of rail supporting portions located on opposite sides of said central portion, each of said rail supporting portions including an upwardly directed rail support pad with said central portion being elevated relative to said pads, fastening means to secure each of said ties to said deck, a pair of rails, one supported on each of said pads, extending between the ties in said direction of movement and a reaction rail supported by and extending between said central portions of adjacent ties generally parallel to said rails.

By supporting the reaction rail on an elevated central portion of the tie, the rail and reaction rail deflect as a unit and thereby maintain the desired air gap between the primary and reaction rail. Moreover, by supporting the reaction rail on the central portion of the tie, the unsupported span of the reaction rail between adjacent ties is reduced and permits the elimination of additional supports between adjacent ties. This not only reduces the weight of the installation but also the cost of the installation.

The tie may be supported on resilient pads on the deck providing the required degree of resilience to inhibit transmission of vibrations.

Figure 2:
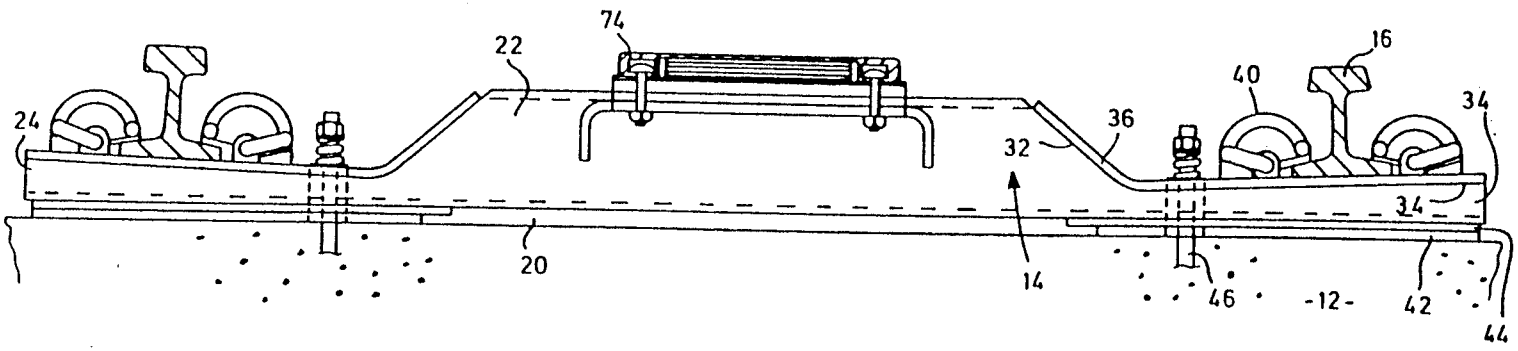
Figure 3:
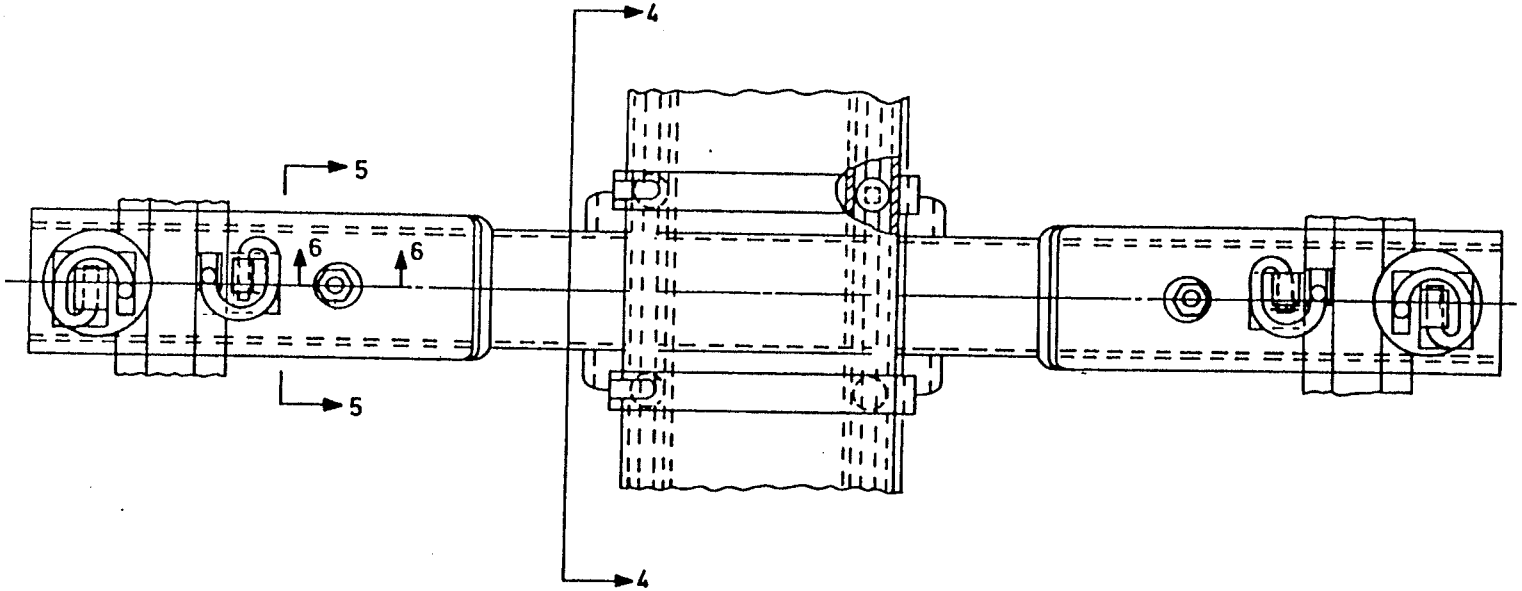
Figure 4:
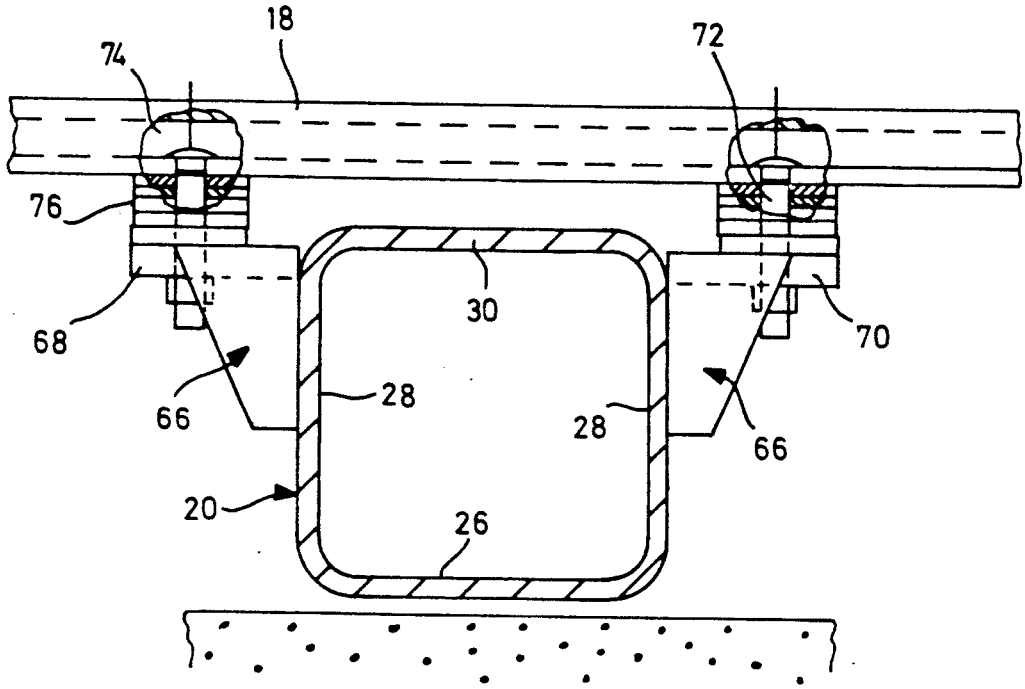
Figure 5:
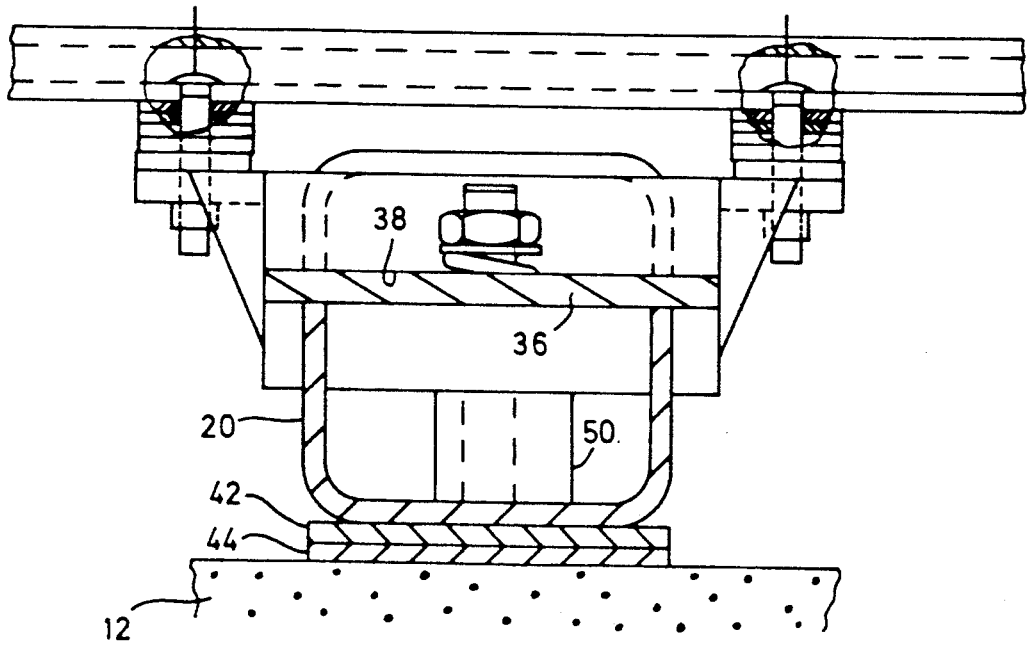
Figure 6:
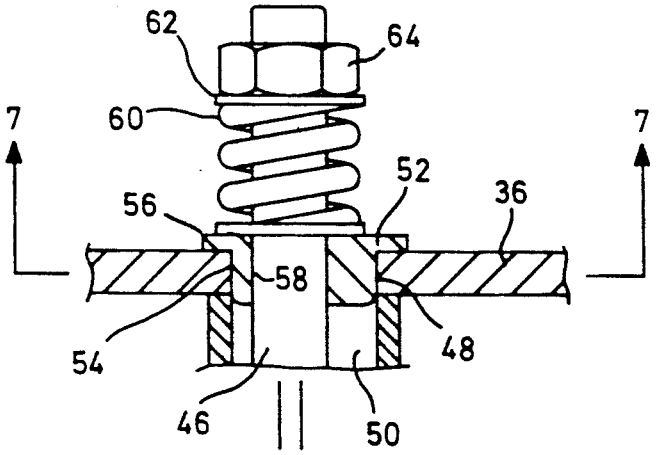
Figure 7:
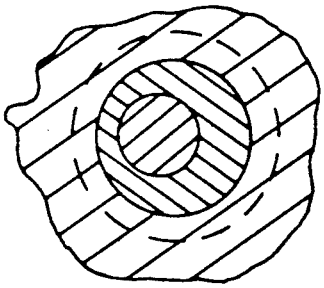

An embodiment of the invention will now be described by way of example only with reference to the accompanying drawings, in which FIG. 1 is a plan view of a portion of a guideway;
FIG. 2 is a view on the line 2—2 of FIG. 1;
FIG. 3 is a plan view of the rail tie shown in FIG. 2;
FIG. 4 is a section on the line 4—4 of FIG. 3;
FIG. 5 is a view on the line 5—5 of FIG. 3;
FIG. 6 is a view on the line 6—6 of FIG. 3; and
FIG. 7 is a view on the line 7—7 of FIG. 6.

Referring therefore to the drawings, a guideway indicated generally at 10 for a rail vehicle includes a deck 12 formed from concrete slab and supporting a plurality of spaced parallel ties 14 Which maintain a pair of running rails 16 in spaced parallel relationship. A reaction rail 18 for co-operation with a primary of a linear induction motor carried on a vehicle (not shown) is supported on the ties 14 midway between the rails 16.

As may be seen from FIGS. 2–5, each of the ties 14 has a generally elongate body 20 with a central portion 22 and a pair of rail supporting portions 24 on opposite sides of the central portion. The body 20 is formed from a hollow structural steel member shown in FIG. 4 having a base 26, a pair of sidewalls 28, and a top surface 30. The top surface 30 and a portion of the sidewalls 28 is removed to define the rail supporting portions 24 and provide a pair of oppositely-inclined upwardly directed surfaces 32,34. A complementary plate 36 is supported on the surfaces 32,34 and welded thereto to provide an upwardly-directed rail support surface 38.

The central portion 22 of body 20 is thus elevated relative to the support surface 38 which is also inwardly canted toward the central portion. A pair of rail fasteners 40 of conventional design are attached to the support surface 38 and hold the rail 16 in place on the tie. The rail fastenings 40 permit limited lateral and vertical adjustment in a conventional manner through the use of inserts and shims, respectively, and will not be described in further detail.

A steel baseplate 42 is welded to the base 26 of the hollow structural member at each end of the tie 14 to create a clearance under the central portion of the tie for longitudinal drainage along the guideway.

The tie 14 is supported on the deck 12 by an elastomeric pad 44 at each end which extends beneath the rail supporting portion 24. The pad 44 is chosen to provide the resilience necessary to absorb the dynamic loads imposed by the vehicle as it rolls along the guideway 10. In a typical installation, the pad 44 will provide a vertical dynamic stiffness of 10,000 kN/m–15,000 Kn/m and it may be made from an elastomeric material having a shore hardness of 25–40.

The body 20 of tie 14 is secured to the deck 12 by means of a stud 46 anchored into the deck 12 and projecting upwardly through circular aperture 48 formed in the base 26 and plate 36. The aperture 48 is located adjacent the necked portion of the body 20 where the inclined surfaces 32,34 converge. A tubular spacer 50 extends between the plate 36 and base 26 with the stud 46 passing through the tubular spacer 50. The aperture 48 is of greater diameter than the stud 46 and accommodates an insert 52. The insert 52 has a cylindrical outer wall 54 conforming in diameter to the diameter of the aperture 48 and a shoulder 56 extending over a portion of the plate 36. A hole 58 is formed in the insert with a diameter corresponding to the diameter of the stud 46. The axis of the hole 58, however, is eccentric to that of the aperture 48 so that rotation of the insert 52 within the aperture 48 will vary the disposition of the hole 58 relative to the tie. In this way, small adjustments of the position of the tie 14 relative to the deck can be accommodated while maintaining a snug fit of the stud 46 to the tie.

The tie 14 is biased toward the resilient pad 44 by a coil spring 60 disposed around the stud 46 between a pair of washers 62. A nut 64 is threaded onto the stud 46 to preload the spring 60 to provide the required bias against the elastomeric pad 44.

A pair of flanges 66 extend from opposite sides of the body 20 in the central portion 22. Each of the flanges 66 is welded to the respective sidewall 28 and includes a horizontal portion 68 that extends laterally outwardly from the body 20 slightly below the upper surface 30. Each of the platforms 66 includes a pair of bolt holes 70 to receive carriage bolts 72. The carriage bolts 72 are used to secure the reaction rail 18 to the ties. For this purpose, the reaction rail 18 includes a pair of downwardly directed re-entrant channels 74 located on opposite sides of the reaction rail so that the bolts 72 can be slid longitudinally relative to the reaction rail into the desired location. The construction of the reaction rail is otherwise conventional and will not be described further.

Shims 76 are located between the reaction rail and the platform 68 to adjust the height of the reaction rail relative to the rails. The amount of adjustment required is minimized due to the fixed relationship between the upper surface of the platform 68 and the rail supporting pad 38 but adjustments, essentially downward, of the reaction rail relative to running rails will be required over the operating years of a system due to wear of the rail head and the consequential drop in the top of rail elevations. However, the adjustment is relatively simple, requiring only the insertion or extraction, as appropriate, of shims of the appropriate thickness to secure the reaction rail to the tie.

In manufacturing the guideway 10, the slab is first cast and the studs 46 either inserted during initial casting or subsequently inserted by drilling the concrete deck. Thereafter, the elastomeric pad 44 is glued (simply to hold them in place) to the baseplates 42 and the ties positioned over the studs 46 on the guideway with the stud 46 passing through the apertures 48. The position of the ties 14 relative to the deck 12 may be adjusted through use of the eccentric insert 52 so that the rail fasteners are aligned and ready to receive each of the rails 16. This adjustment compensates for any discrepancies that may inevitably arise during installation of the studs.

The rail 16 is then installed in the fasteners 40, the final alignment adjustment made, and the reaction rail then installed. The reaction rail may be installed in 3 m–10 m lengths as appropriate with a nominal gap between each length. For convenience, the shims 76 are supplied as a pack with a total thickness of 20 mm, consisting of two 5 mm shims, three 2 mm shims and four 1 mm shims. This combination allows an incremental height adjustment of 1 mm, as and when necessary due to rail head wear. Thereafter, the reaction rail 18 is firmly secured to the tie by tightening the carriage bolt 72.

As a vehicle passes along the guideway, the axle loads will cause deflection of the tie 14 relative to the guideway 12 which is absorbed by the support pad 44. During deflection of the elastomeric pads, the preload in spring 60 is sufficient to maintain the stud 46 under tension and so avoids alternate loading and unloading of the stud 46 as would occur with a direct bolted connection.

The provision of the stud 46 in the necked portion of the tie between the rail supporting portion and the body portion 22 provides a reduction in the length of the stud 46 but also reduces the overall length of the tie. The unsupported length of the tie between the anchors is also reduced and the precompression of the resilient pad 44 is more uniformly distributed.

It will be noted, therefore, that the guideway described above attaches each of the ties through two studs and does not require the reaction rail to be attached directly to the deck 12. The previous arrangement referred to above, by contrast, utilized four studs to secure the rails to the deck and four studs to secure the LIM to the deck. A significant reduction in the anchors required in the deck is thus obtained. A further advantage with the design shown in this application results from the provision of the laterally extending flanges 66. By extending the platform 68 beyond the body 20, the unsupported length of the LIM between adjacent ties is reduced and thereby eliminates inter-tie fastening of the LIM to the deck.

It will be seen, therefore, that an integral tie is provided which allows economical fastening to the deck with an appropriate low stiffness while ensuring that the gap between the reaction rail and the LIM primary is maintained.

We claim:

1. A rail tie comprising an elongate body having a central portion and a pair of rail supporting portions located on opposite sides of said central portion, each of said rail supporting portions including an upwardly directed rail support pad to receive a rail, said central portion being elevated relative to said pad and including a pair of flanges projecting laterally outwardly from opposite sides of said central portion at a location above said pads to provide a support for a reaction rail extending between adjacent ties.

2. A rail tie according to claim 1 wherein each of said support pads is canted inwardly toward said central portion to provide a neck between said pads and said central portion.

3. A rail tie according to claim 2 wherein an aperture is formed in said neck to receive a fastener to secure said tie to a deck.

4. A rail tie according to claim 3 wherein an insert is located in said aperture, said inset having a hole therethrough disposed eccentric to said aperture whereby rotation of said insert in said aperture varies the position of said hole.

5. A tie according to claim 4 wherein each flange includes a pair of bolt holes to secure a reaction rail thereto.

6. A tie according to claim 4 wherein said flanges are disposed adjacent to the upper surface of said central portion.

7. A tie according to claim 2 having a tubular central portion having a base and a pair of side walls formed as a channel, said side walls being profiled on opposite sides of said central portion to provide said neck, and a top plate extending between said sidewalls along the length of the profiled portion thereof to provide said support pads and thereby define a generally tubular construction for said tie.

8. A guideway for a rail vehicle comprising a deck, a plurality of ties spaced apart generally parallel to one another transverse to the direction of movement of the vehicle along said guideway, each of said ties having a central portion and a pair of rail supporting portions located on opposite sides of said central portion, each of said rail supporting portions including an upwardly directed rail support pad with said central portion being elevated relative to said pads, said rail support pads being inwardly canted toward said central portion to provide a neck between said pads and said central portion, fastening means to secure each of said ties to said deck and including an anchor extending through an aperture formed in said neck and secured to said deck, a pair of rails, one supported on each of said pads, extending between the ties in said direction of movement and a reaction rail supported by and extending between said central portions of adjacent ties generally parallel to said rails.

9. A guideway according to claim 8 including a resilient support located between said tie and said deck beneath each of said rail supporting portions.

10. A guideway according to claim 9 wherein a resilient biasing means acts between said anchor and said tie to bias said tie toward said deck.

11. A guideway according to claim 10 wherein said biasing means includes a coil spring disposed about said anchor.

12. A guideway according to claim 9 wherein an insert is provided in said aperture and said bolt passes through a hole formed in said insert and eccentric to said aperture.

13. A guideway according to claim 12 wherein said insert is rotatable in said aperture to adjust the position of said bolt relative to said tie.

14. A guideway according to claim 8 including a pair of flanges each extending to an opposite side of said central portion toward an adjacent tie at a location above said pads to support said reaction rail.

15. A guideway according to claim 14 wherein said reaction rail is secured to each of said flanges.

16. A guideway according to claim 15 wherein a pair of downwardly directed channels are provided on opposite edges of said reaction rail to receive a fastener for securing said reaction rail to said flange.

17. A guideway according to claim 16 wherein each of said fasteners is slidably received in said channel.

18. A guideway according to claim 8 including a tubular central portion having a base and a pair of side walls formed as a channel, said side walls being profiled on opposite sides of said central portion to provide said neck, and a top plate extending between said sidewalls along the length of the profiled portion thereof to provide said support pads and thereby define a generally tubular construction for said tie.

19. A rail tie comprising an elongate body having a central portion and a pair of rail supporting portions disposed on opposite sides of said central portion, each of said rail supporting portions including an upwardly directed rail support pad to receive a rail, an aperture extending through said tie adjacent each of said rail support pads to receive a fastener to secure said tie to a deck and an insert located in each of said apertures, each of said inserts having a hole therethrough disposed eccentric to said aperture whereby rotation of said insert in said aperture varies the position of said hole.

20. A rail tie according to claim 19 wherein said central portion is elevated relative to said rail support pads.

21. A rail tie according to claim 20 wherein said aperture is located between said rail support pads and said central portion.

22. A rail tie according to claim 21 wherein each of said rail support pads is canted inwardly toward said central portion to provide a neck between said pads and said central portion.

23. A rail tie according to claim 22 wherein a tubular central portion having a base and a pair of side walls formed as a channel, said side walls being profiled on opposite sides of said central portion to provide said neck and a top plate extending between said sidewalls along the length of the profiled portion thereof to provide said support pads and thereby define a generally tubular construction for said tie.

24. A rail tie according to claim 23 wherein a pair of flanges project laterally to opposite sides of said central portion at a location above said pads.

* * * * *